US008168004B2

(12) United States Patent
Lee et al.

(10) Patent No.: US 8,168,004 B2
(45) Date of Patent: May 1, 2012

(54) METHOD FOR CONTROLLING OPERATION OF THE WASHING MACHINE

(75) Inventors: Phal Jin Lee, Jinhae-si (KR); Dong Won Kang, Changwon-si (KR); Kwang Cheol Park, Busan (KR)

(73) Assignee: LG Electronics Inc., Seoul (KR)

( * ) Notice: Subject to any disclaimer, the term of this patent is extended or adjusted under 35 U.S.C. 154(b) by 960 days.

(21) Appl. No.: 11/629,672

(22) PCT Filed: Mar. 23, 2006

(86) PCT No.: PCT/KR2006/001075

§ 371 (c)(1),
(2), (4) Date: Jul. 14, 2008

(87) PCT Pub. No.: WO2006/101361

PCT Pub. Date: Sep. 28, 2006

(65) Prior Publication Data

US 2009/0038084 A1 Feb. 12, 2009

(30) Foreign Application Priority Data

Mar. 25, 2005 (KR) ..... 10-2005-0025107
Jun. 30, 2005 (KR) ..... 10-2005-0057971
Aug. 19, 2005 (KR) ..... 10-2005-0076145

(51) Int. Cl.

| | |
|---|---|
| ***B08B 7/04*** | (2006.01) |
| ***B08B 3/06*** | (2006.01) |
| ***B08B 3/10*** | (2006.01) |
| ***B08B 5/00*** | (2006.01) |
| ***D06B 21/02*** | (2006.01) |
| ***D06B 5/12*** | (2006.01) |
| ***D06B 5/22*** | (2006.01) |
| ***D06B 5/26*** | (2006.01) |
| ***D06B 1/04*** | (2006.01) |
| ***D06F 18/00*** | (2006.01) |
| ***D06F 39/04*** | (2006.01) |
| ***D06F 33/00*** | (2006.01) |

(52) U.S. Cl. ..... 134/18; 134/19; 8/137; 8/149.1; 8/149.2; 8/149.3; 8/159; 68/5 R; 68/5 C; 68/12.01; 68/12.02; 68/15

(58) Field of Classification Search ..... 8/137, 149.1, 8/149.2, 149.3, 159; 68/5 C, 5 R, 12.02, 68/15; 134/18

See application file for complete search history.

(56) References Cited

U.S. PATENT DOCUMENTS 4,024,432 A 5/1977 Boekhorst (Continued)

FOREIGN PATENT DOCUMENTS

CN 1534130 A 10/2004

(Continued)

OTHER PUBLICATIONS

English abstract of JP-04064389, Shimano, Feb. 28, 1992.*

(Continued)

*Primary Examiner* — Michael Kornakov
*Assistant Examiner* — Natasha Campbell
(74) *Attorney, Agent, or Firm* — McKenna Long & Aldridge LLP

(57) ABSTRACT

A washing machine that is capable of providing a stable washing mode even when a washing-related device is abnormal during a washing operation is disclosed. When a steam generation unit, which generates high-temperature steam into a drum, is abnormal, the operation of the steam generation unit is interrupted, and an operation for driving a washing heater mounted in a tub is performed, or an operation for driving a drying unit, which supplies high-temperature dry hot air into the drum, is performed. A steam substituting algorithm is provided when the steam generation unit is abnormal during the operation using the high-temperature steam. Consequently, the interruption of the washing operation due to the abnormal steam injection function is prevented, and therefore, the reliability of the product is improved while the inconvenience of use is minimized.

18 Claims, 9 Drawing Sheets

U.S. PATENT DOCUMENTS

| | | | | |
|---|---|---|---|---|
| 2004/0187527 | A1 * | 9/2004 | Kim et al. | 68/5 C |
| 2004/0244432 | A1 | 12/2004 | Kim et al. | |
| 2004/0255391 | A1 * | 12/2004 | Kim et al. | 8/149.3 |
| 2006/0016020 | A1 | 1/2006 | Park | |

FOREIGN PATENT DOCUMENTS

| | | | | |
|---|---|---|---|---|
| DE | 197 43 508 | A1 | | 4/1999 |
| DE | 19743508 | A1 | * | 4/1999 |
| DE | 197 51 028 | | | 5/1999 |
| EP | 1 275 767 | | | 1/2003 |
| EP | 1 616 990 | A1 | | 1/2006 |
| JP | 04064389 | A | * | 2/1992 |
| JP | 7-59995 | A | | 3/1995 |
| KR | 10-2002-0076589 | A | | 10/2002 |
| WO | WO 2005/001189 | | | 1/2005 |

OTHER PUBLICATIONS

Machine translation, DE 19743508, Stolze, Apr. 8, 1999.*
English translation of DE 19743508, A. Stolze, 1999.*

* cited by examiner

[Fig. 1]
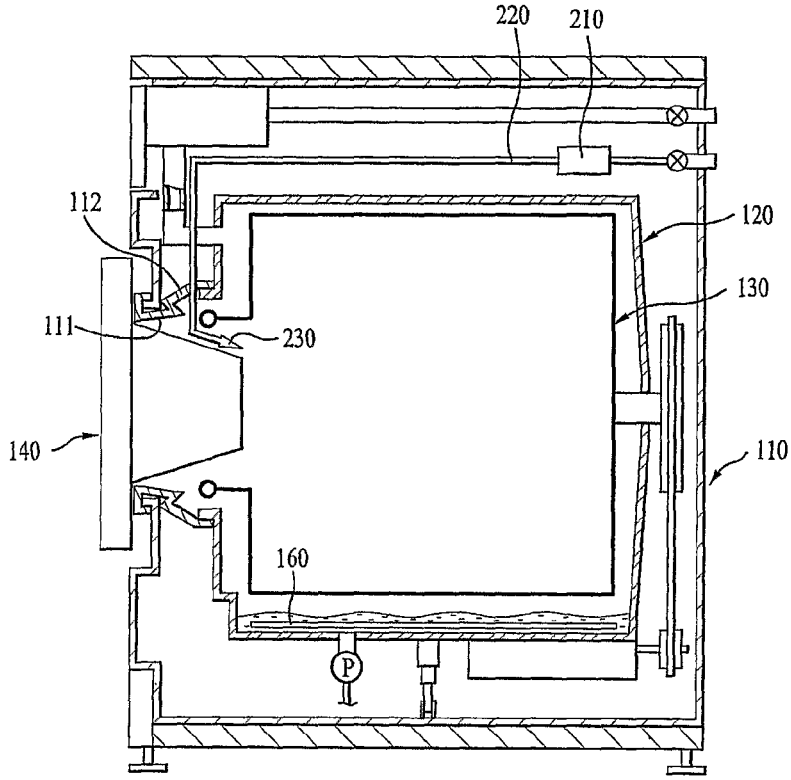
[Fig. 2]
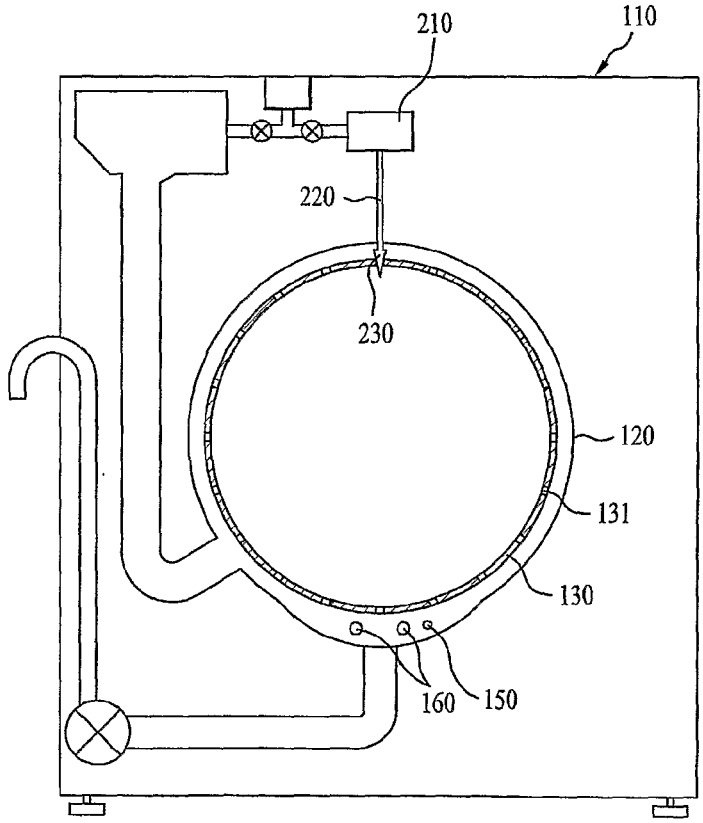

[Fig. 3]
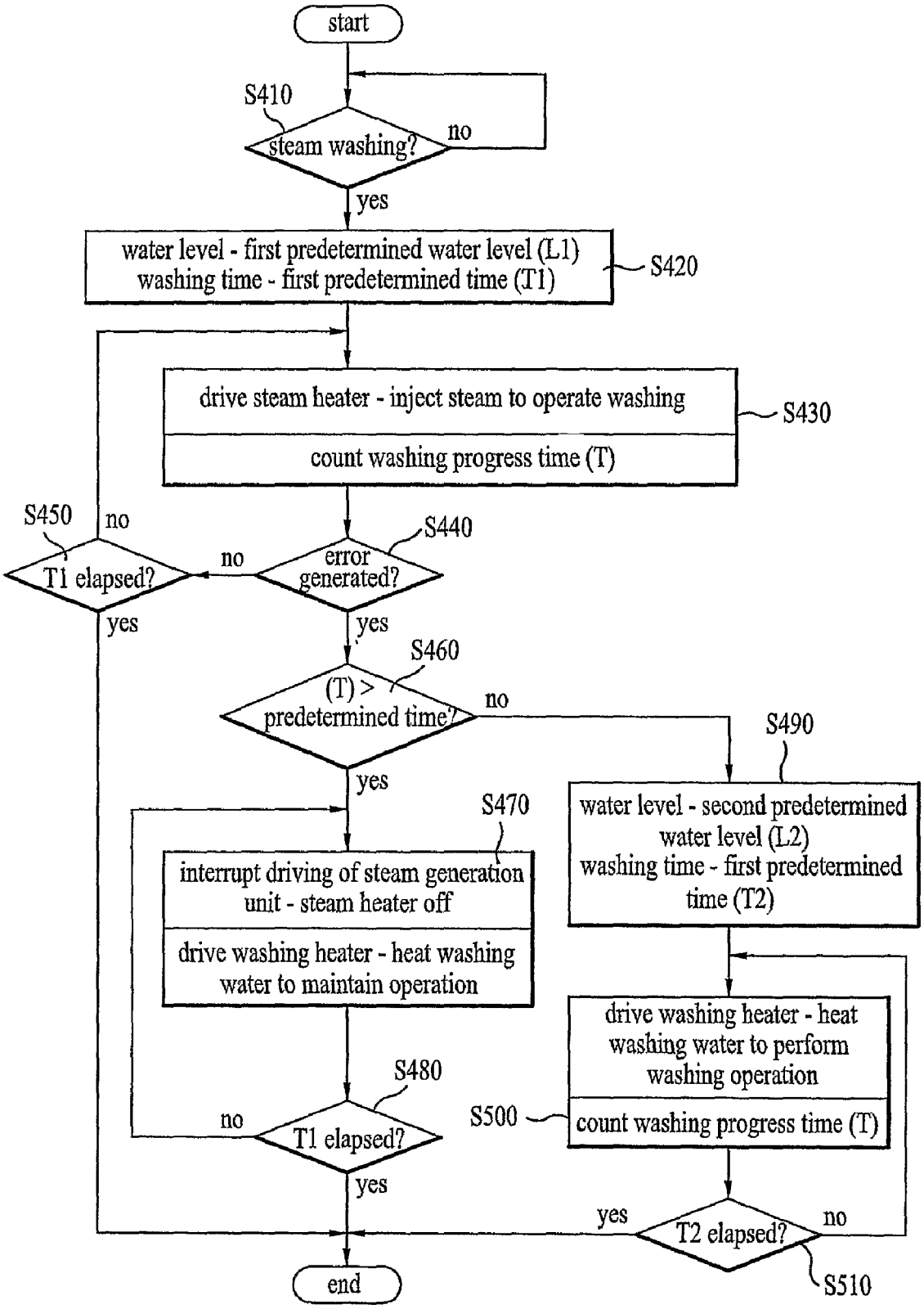

[Fig. 4]
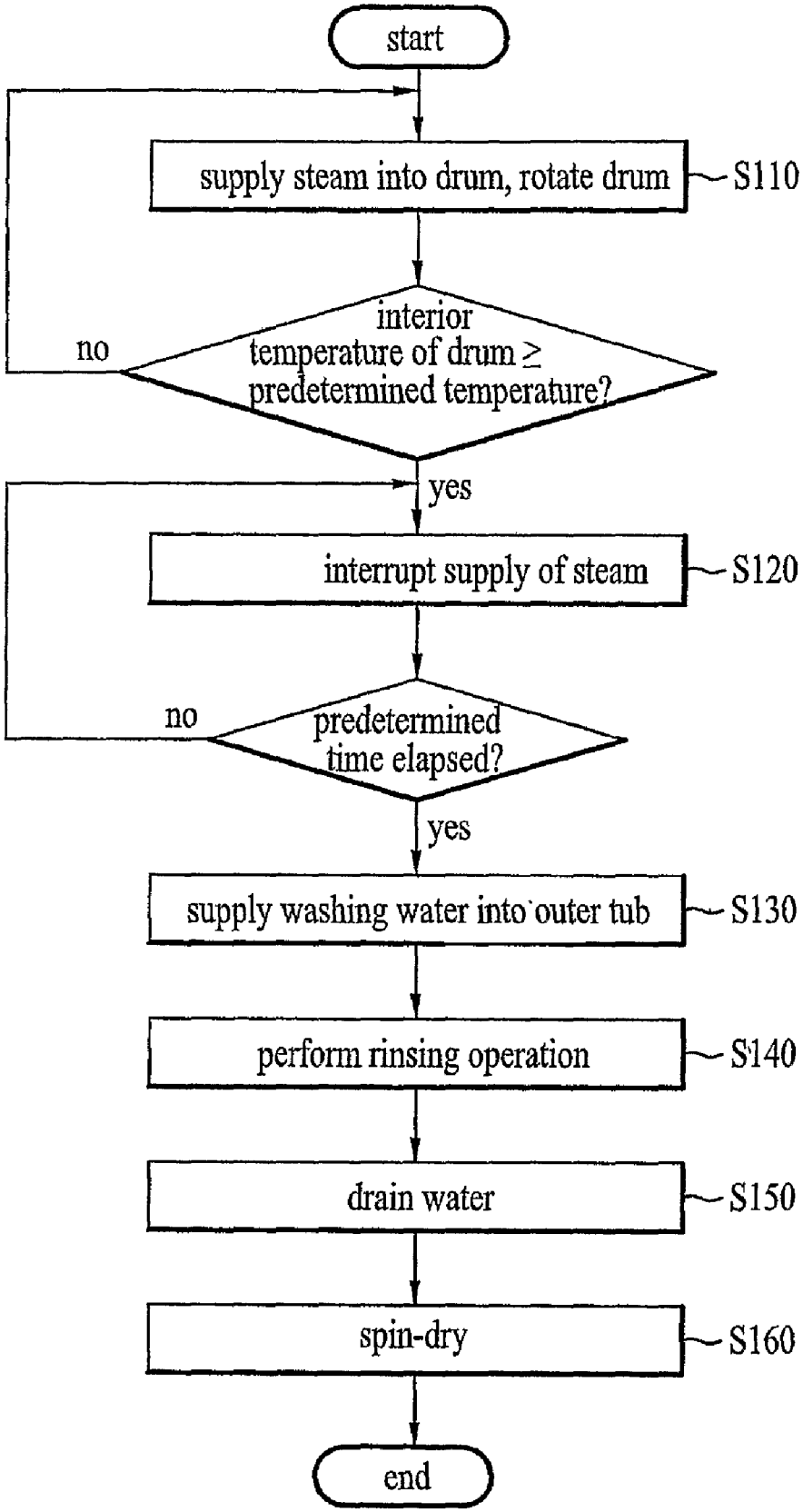

[Fig. 5]
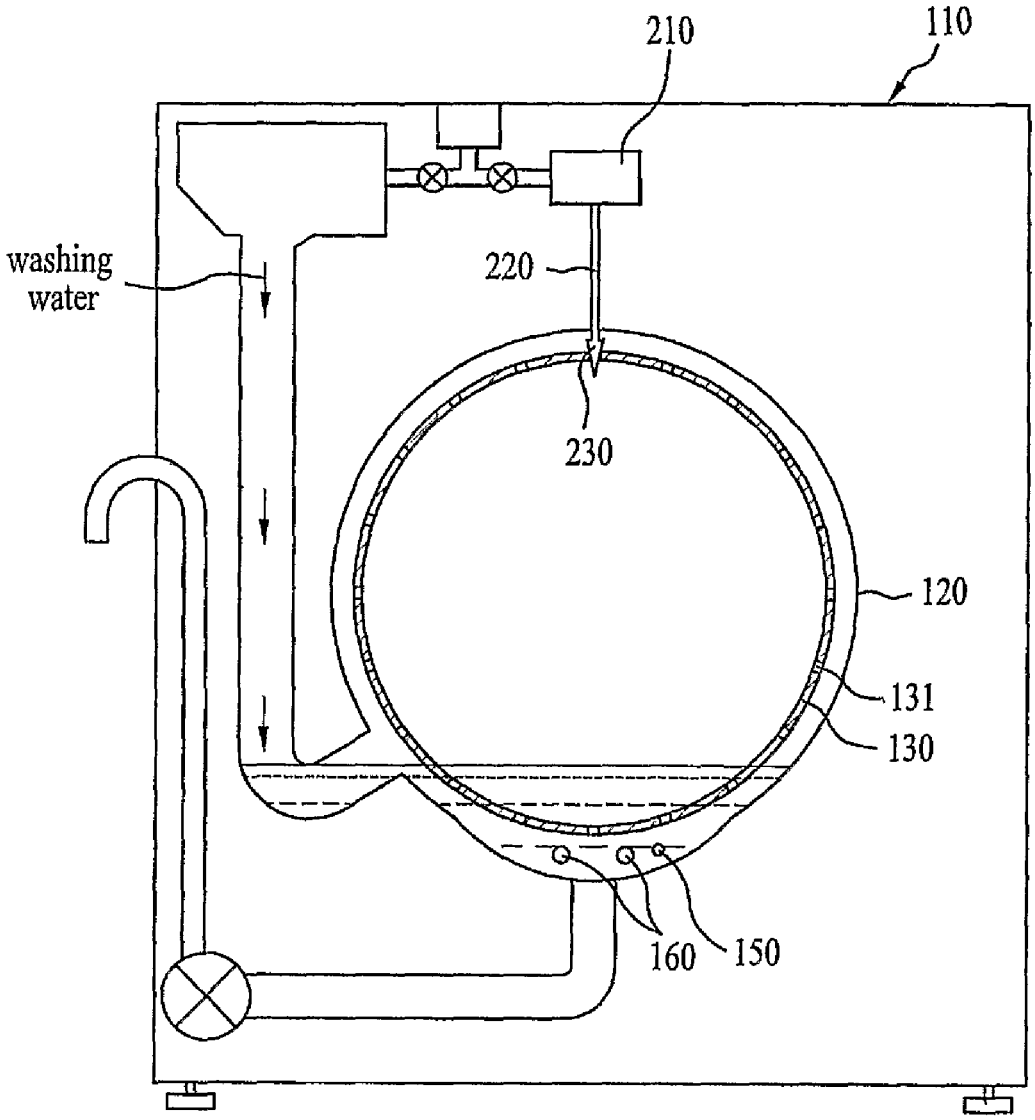

[Fig. 6]
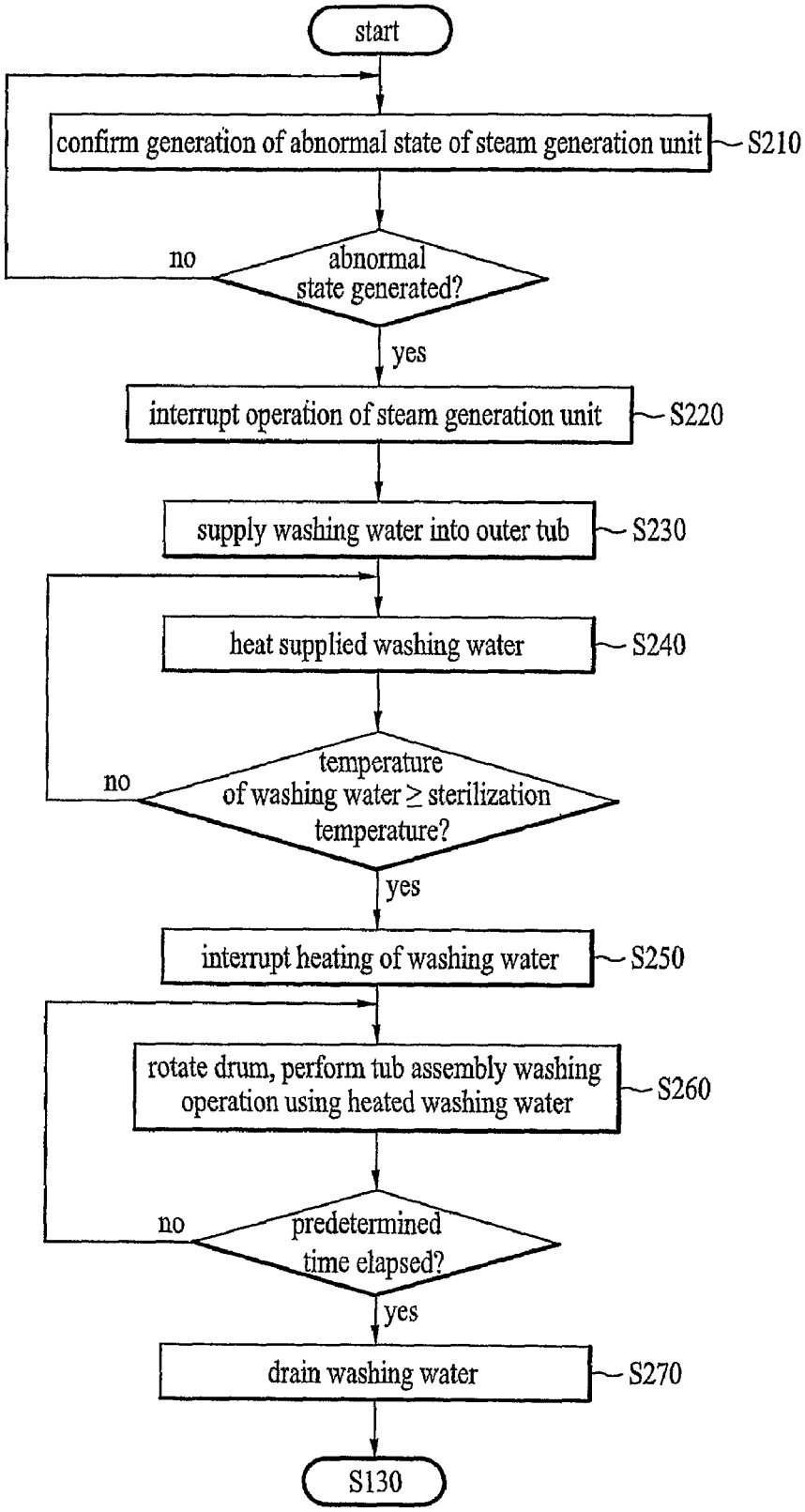

[Fig. 7]
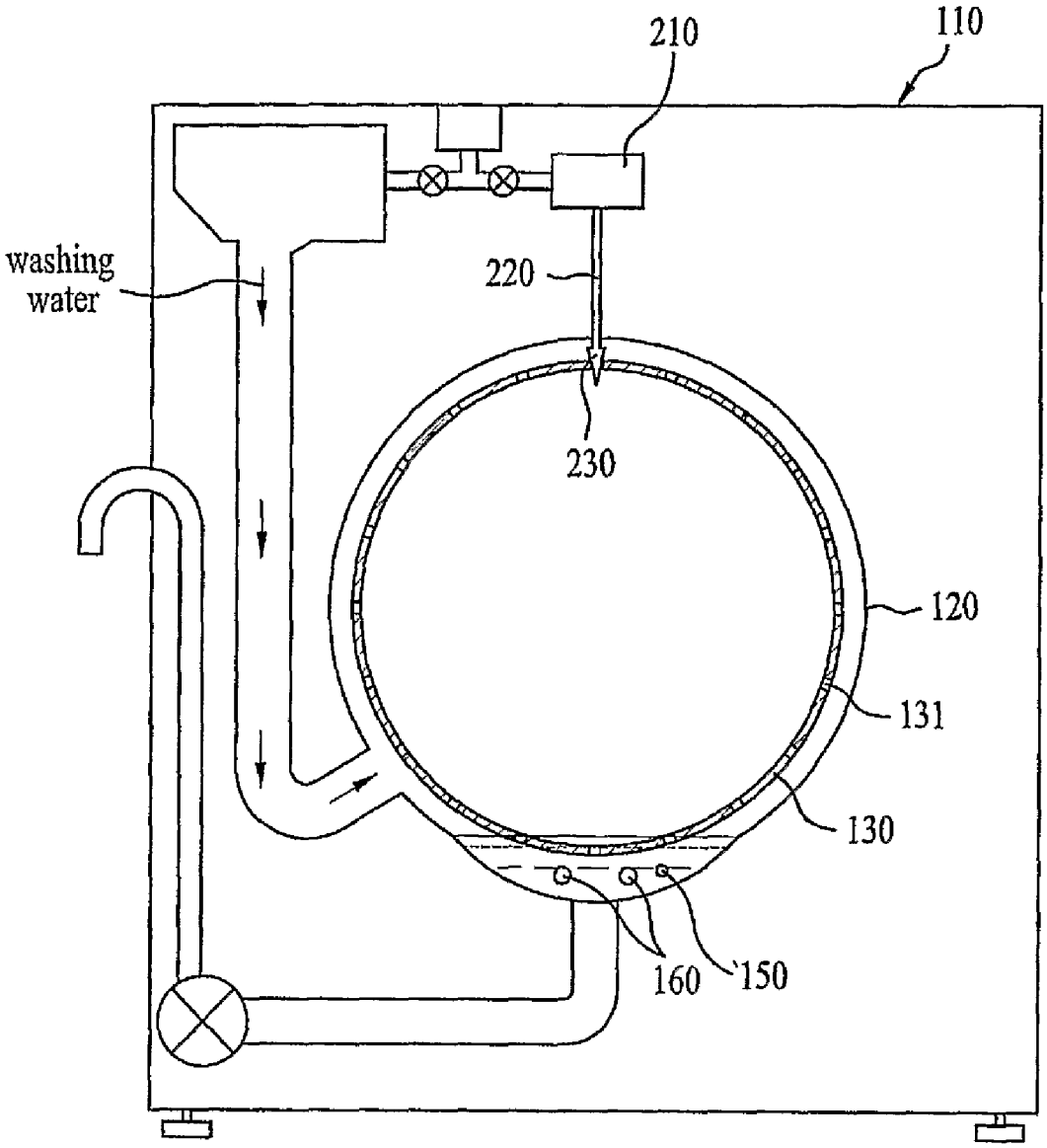

[Fig. 8]
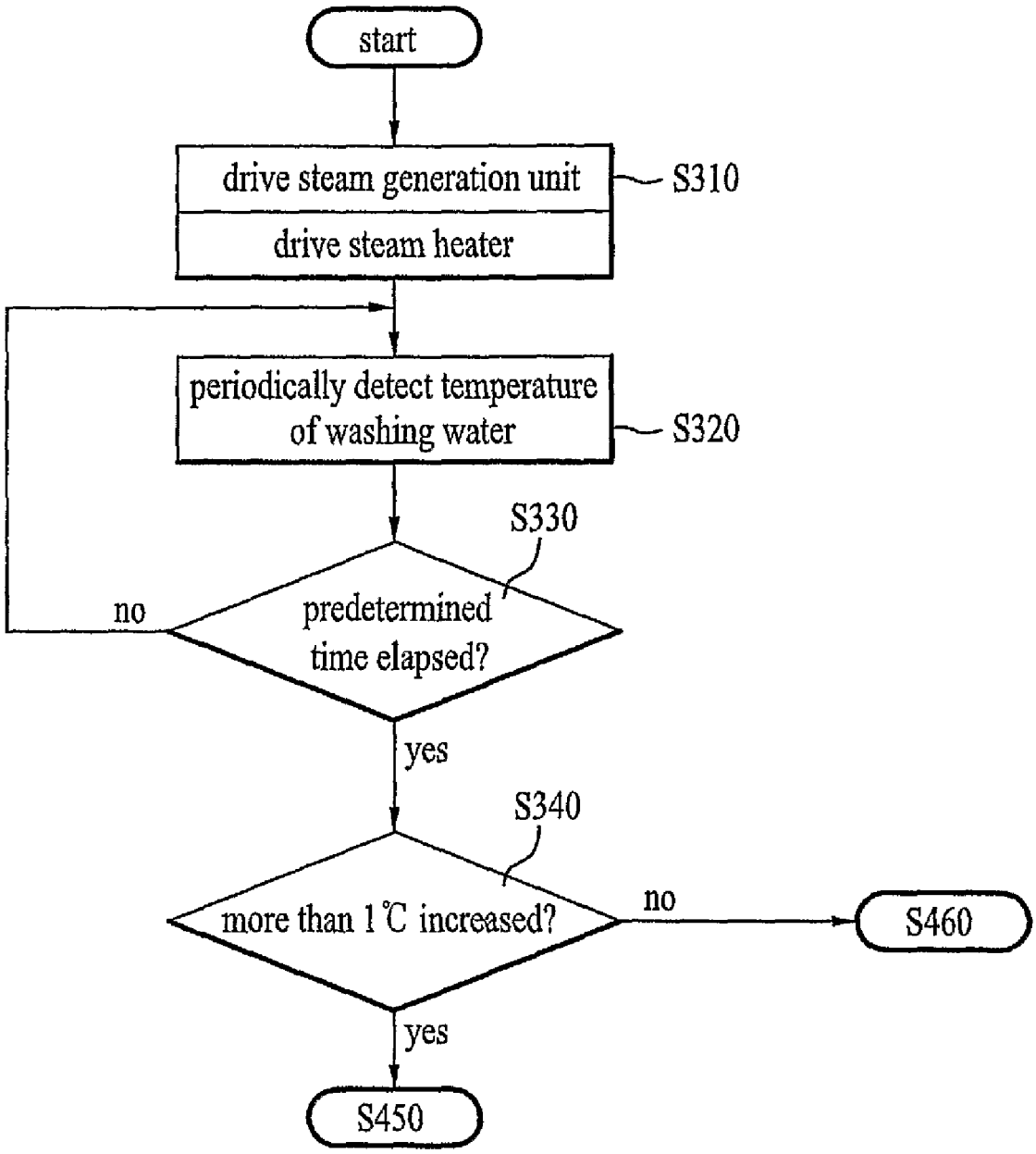

[Fig. 9]
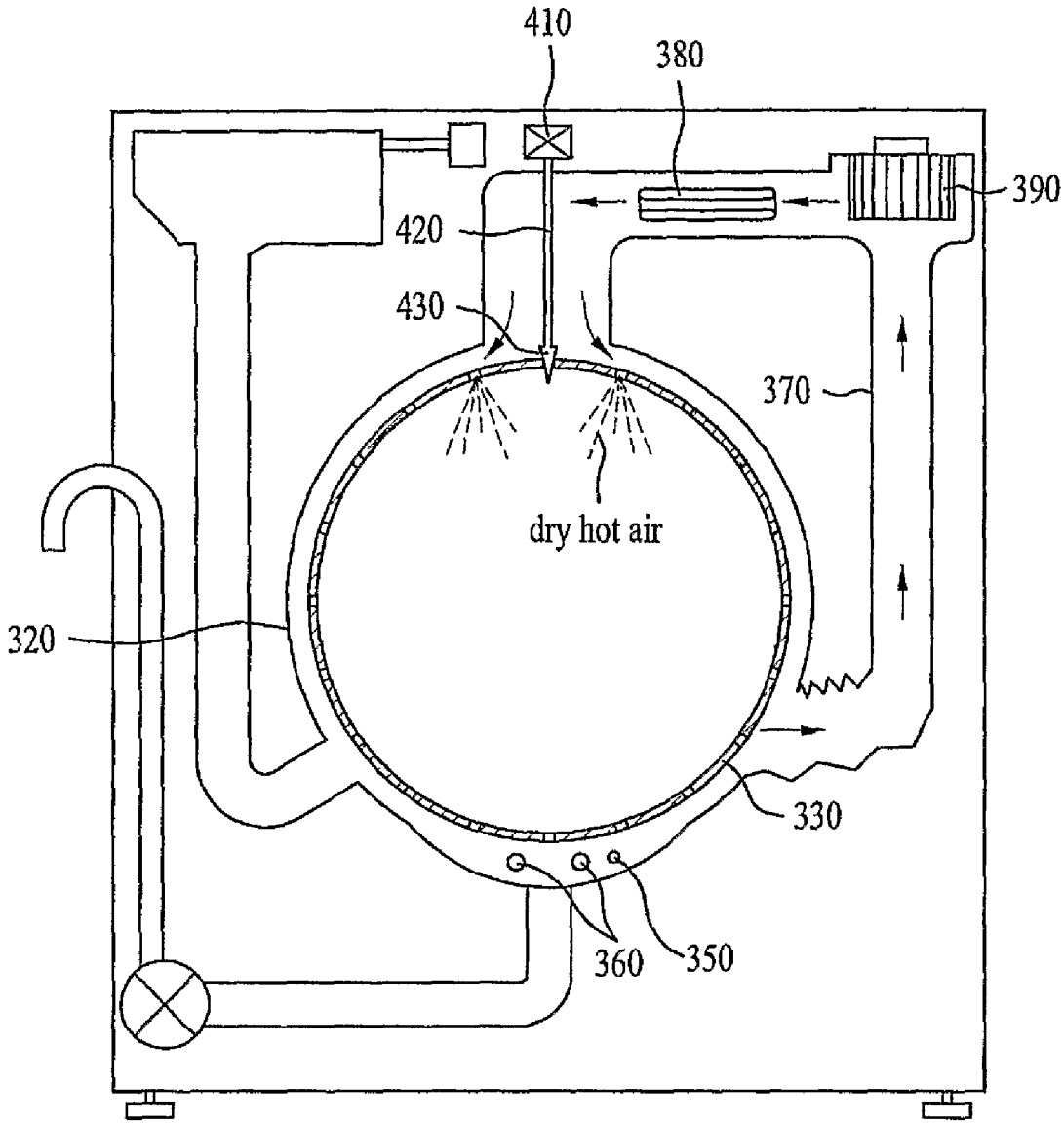

[Fig. 10]
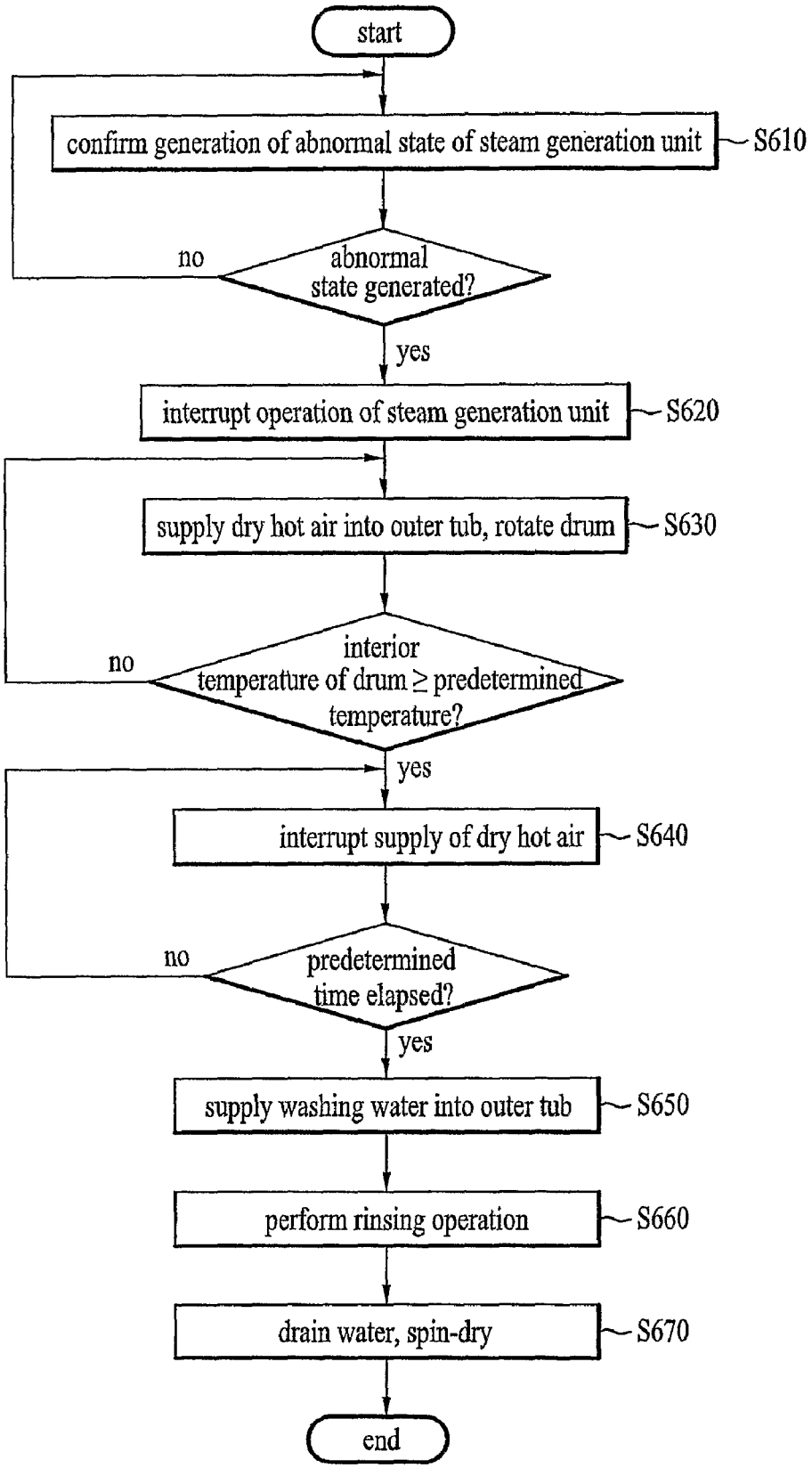

METHOD FOR CONTROLLING OPERATION OF THE WASHING MACHINE

This application claims priority to International application No. PCT/KR2006/001075 filed on Mar. 23, 2006, Korean Application No. 10-2005-0025107 filed on Mar. 25, 2005, Korean Application No. 10-2005-0057971 filed on Jun. 30, 2005, Korean Application No. 10-2005-0076145 filed on Aug. 19, 2005, all of which are incorporated by reference, as if fully set forth herein.

TECHNICAL FIELD

The present invention relates to a washing machine, and more particularly, to an operation control method of a washing machine having a steam generation unit for supplying high-temperature steam.

BACKGROUND ART

Generally, washing machines are electric home appliances that are widely used at home. The washing machines are machines that remove contaminants from laundry, such as clothes or bedclothes, using emulsification of detergent, friction of washing water motion generated by washing machine drum rotation, and impact applied to the laundry.

Washing machines are classified into a pulsator type washing machine, a drum of which is mounted in a vertical direction, and a drum type washing machine, the drum of which is mounted in a horizontal direction.

Normally, a washing operation is a course of supplying detergent and washing water to laundry to be washed such that contaminants can be removed from the laundry by a chemical action of the detergent contained in the washing water and a physical action of a drum.

A rinsing operation is a course of supplying washing water containing no detergent therein such that the detergent and contaminants can be rinsed out of the laundry, and a spin-drying operation is a course of rotating a washing tub at high speed, after the rinsing operation is completed, such that moisture can be removed from the laundry.

In recent years, as the awareness level of drum type washing machines that can wash laundry with reduced damage to the laundry has increased, and therefore, the use of the drum type washing machines has greatly increased, washing-and-drying machines, which are capable of washing and drying laundry, thereby improving the convenience of use, have been placed on the market.

The conventional washing machines consume a relatively large amount of washing water while a washing operation is carried out. For this reason, attempts to minimize the amount of washing water used to wash laundry have been made in recent years.

As a result of such attempts, there has been developed a washing machine having a steam generation unit mounted therein. The steam generation unit serves to supply high-temperature steam into a drum of the washing machine such that a washing operation can be carried out with high efficiency using a relatively small amount of washing water.

On the other hand, when various mixtures, such as contaminants separated from the laundry or residua of detergent, are accumulated or attached to the inner/outer wall of the drum and inside the tub, laundry to be washed is contaminated during the washing operation, and therefore, the washing efficiency is lowered.

Furthermore, when the tub assembly (which includes the drum and the tub) is contaminated, a bad smell is given off from the interior of the washing water by bacilli, such as mold, growing on the contaminants.

In the conventional art, in order to solve the tub assembly contamination, only washing water is supplied into the drum while laundry to be washed is not placed in the drum, and then the drum is submerged in the washing water for a long period of time while detergent is dissolved in the washing water to wash the tub assembly.

DISCLOSURE OF INVENTION

Technical Problem

In the conventional tub assembly washing method, however, the tub assembly washing time is very long, a large amount of washing water is consumed, and, furthermore, the removal of the contaminants is not expected.

Consequently, a more efficient tub assembly washing process that is capable of solving the tub assembly contamination problem in the washing machine itself is required.

Technical Solution

Therefore, the present invention has been made in view of the above problems, and it is an object of the present invention to provide an operation control method of a washing machine that is capable of improving the washing efficiency.

It is another object of the present invention to provide an operation control method of a washing machine that is capable of providing a stable washing mode even when a washing-related device functions abnormally during a washing operation.

It is a further object of the present invention to provide an operation control method of a washing machine that is capable of providing an effective tub assembly washing mode.

Additional advantages, objects, and features of the present invention will be set forth in part in the following description of preferred embodiments.

The object of the present invention can be achieved by providing an operation control method of a washing machine, comprising the steps of: (a) driving a steam generation unit having a steam heater to perform a steam operation for generating and supplying high-temperature steam into a drum; (b) determining whether the steam generation unit is abnormal during the steam operation; and (c) when it is determined that the steam generation unit is abnormal, interrupting the operation of the steam generation unit, and performing an operation for driving a washing heater mounted in a tub, instead of operating the steam generation unit.

The present invention is characterized in that the steam operation of the (a) step is a tub assembly washing operation for washing the inner/outer wall of the drum using the high-temperature steam, which includes the steps of: generating and supplying high-temperature steam into the drum while rotating the drum; determining whether the interior temperature (T) of the drum has exceeded a predetermined temperature level (T1) due to the generation of the steam; when it is determined that the interior temperature (T) of the drum has exceeded the predetermined temperature level (T1), interrupting the steam generation while maintaining the rotation of the drum; after the steam generation is interrupted, and a predetermined period of time (t) has elapsed, supplying washing water up to a predetermined water level (H), performing a rinsing operation of the washed tub assembly using the supplied washing water while rotating the drum; and, after the rinsing operation is completed, performing a draining operation of the washing water and a spin-drying operation.

Preferably, the predetermined water level (H) is a water level at which the lowermost surface of the drum is submerged in the washing water.

The present invention is characterized in that the step of determining whether the steam generation unit is abnormal at the (b) step includes the steps of: detecting the initial interior temperature of the drum immediately after the steam operation of the (a) step is initiated, and counting steam operation time from the point of time at which the steam operation is initiated; determining whether the counted steam operation time has exceeded a predetermined time; detecting the current interior temperature of the drum at the point of time at which the counted steam operation time has exceeded the predetermined time, and comparing the current interior temperature of the drum with the initial interior temperature of the drum; determining whether the current interior temperature of the drum has increased by more than a predetermined temperature level as compared to the initial interior temperature of the drum; and, when it is determined that the current interior temperature of the drum has not increased by more than the predetermined temperature level as compared to the initial interior temperature of the drum, recognizing the steam generation unit as being abnormal.

In another aspect of the present invention, provided herein is an operation control method of a washing machine, comprising the steps of: (a) driving a steam generation unit having a steam heater to perform a steam operation for generating and supplying high-temperature steam into a drum; (b) determining whether the steam generation unit is abnormal during the steam operation; and (c) when it is determined that the steam generation unit is abnormal, interrupting the operation of the steam generation unit, and performing an operation for driving a drying unit, which performs a drying function, to supply high-temperature dry hot air into the drum, instead of operating the steam generation unit.

In another aspect of the present invention, provided herein is an operation control method of a washing machine, comprising the steps of: (a) establishing a first operation condition for a steam operation for generating high-temperature steam; (b) driving a steam generation unit according to the established first operation condition to perform a steam operation for generating and supplying high-temperature steam into a drum; (c) determining Whether the steam generation unit is abnormal during the steam operation; and (d) when it is determined that the steam generation unit is abnormal, interrupting the operation of the steam generation unit, and performing an operation for driving a washing heater mounted in a tub, instead of performing the steam operation.

Preferably, the operation condition at the (a) step includes at least one of water level, operation time, and washing water heating temperature.

The present invention is characterized in that the step of determining whether the steam generation unit is abnormal at the (c) step includes the steps of: detecting the initial interior temperature of the drum immediately after the steam operation of the (b) step is initiated, and counting steam operation time from the point of time at which the steam operation is initiated; determining whether the counted steam operation time has exceeded a predetermined time; detecting the current interior temperature of the drum at the point of time at which the counted steam operation time has exceeded the predetermined time, and comparing the current interior temperature of the drum with the initial interior temperature of the drum; determining whether the current interior temperature of the drum has increased by more than a predetermined temperature level as compared to the initial interior temperature of the drum; and, when it is determined that the current interior temperature of the drum has not increased by more than the predetermined temperature level as compared to the initial interior temperature of the drum, recognizing the steam generation unit as being abnormal.

The present invention is characterized in that the step of driving the washing heater at the (d) step includes the steps of: counting steam operation time from the point of time at which the steam operation of the (b) step is initiated; when the steam generation unit is abnormal, determining the point of time at which the abnormal state of the steam generation unit occurs; when the abnormal state of the steam generation unit has occurred before the counted steam operation time exceeds the predetermined time, ignoring the first operation condition established at the (a) step, and establishing a second operation condition for an operation using the washing heater; and performing an operation for driving the washing heater according to the established second operation condition.

In a further aspect of the present invention, provided herein is an operation control method of a washing machine, comprising the steps of: (a) establishing a first operation condition for a steam operation for generating high-temperature steam; (b) driving a steam generation unit according to the established first operation condition to perform a steam operation for generating and supplying high-temperature steam into a drum; (c) determining whether the steam generation unit is abnormal during the steam operation; and (d) when it is determined that the steam generation unit is abnormal, interrupting the operation of the steam generation unit, and performing an operation for driving a drying unit, which performs a drying function, to supply high-temperature dry hot air into the drum, instead of operating the steam generation unit.

The present invention is characterized in that the step of driving the drying unit at the (d) step includes the steps of: counting steam operation time from the point of time at which the steam operation of the (b) step is initiated; when the steam generation unit is abnormal, determining the point of time at which the abnormal state of the steam generation unit occurs; when the abnormal state of the steam generation unit has occurred before the counted steam operation time exceeds the predetermined time, ignoring the first operation condition established at the (a) step, and establishing a second operation condition for an operation using the drying unit; and performing an operation for driving the drying unit according to the established second operation condition to supply high-temperature dry hot air into the drum.

Advantageous Effects

The operation control method of the washing machine according to the present invention has the following effects.

First, the interior of the drum is maintained at high temperature and high humidity by the steam. Consequently, the contaminants are easily removed from the tub assembly, and therefore, the washing environment is improved.

Secondly, the tub assembly washing operation is performed using the steam. Consequently, the washing water consumption and the operation progress time are minimized, and therefore, the energy consumption is reduced.

Thirdly, the steam substituting algorithm is provided when the steam generation unit is abnormal during the washing operation using the high-temperature steam. Consequently, the interruption of the washing operation due to the abnormal steam injection function is prevented, and therefore, the reliability of the product is improved while the inconvenience of use is minimized.

BRIEF DESCRIPTION OF THE DRAWINGS

The accompanying drawings, which are included to provide a further understanding of the invention, illustrate embodiments of the invention and together with the description serve to explain the principle of the invention.

In the drawings:

FIG. 1 is a side view, in section, illustrating the interior structure of a drum type washing machine according to a first preferred embodiment of the present invention.

FIG. 2 is a front view, in section, illustrating the interior structure of the drum type washing machine according to the first preferred embodiment of the present invention.

FIG. 3 is a flow chart illustrating an operation procedure performed when a steam generation unit is abnormal during a steam washing operation of the drum type washing machine according to the first preferred embodiment of the present invention.

FIG. 4 is a flow chart illustrating a tub assembly washing operation method in the steam washing operation of the drum type washing machine according to the first preferred embodiment of the present invention.

FIG. 5 is a state view illustrating the tub assembly washing operation method of FIG. 4.

FIG. 6 is a flow chart illustrating an operation procedure performed when the steam generation unit is abnormal during the tub assembly washing operation of the drum type washing machine according to the first preferred embodiment of the present invention.

FIG. 7 is a state view illustrating the operation procedure performed when the steam generation unit is abnormal as shown in FIG. 6.

FIG. 8 is a flow chart illustrating a method of detecting the abnormal state of the steam generation unit of the drum type washing machine according to the first preferred embodiment of the present invention.

FIG. 9 is a front view, in section, illustrating the interior structure of a drum type washing machine according to a second preferred embodiment of the present invention.

FIG. 10 is a flow chart illustrating an operation procedure performed when a steam generation unit is abnormal during a tub assembly washing operation of the drum type washing machine according to the second preferred embodiment of the present invention.

BEST MODE FOR CARRYING OUT THE INVENTION

Reference will now be made in detail to the preferred embodiments of the present invention, examples of which are illustrated in the accompanying drawings.

First, a washing machine according to a first preferred embodiment of the present invention, i.e., a drum type washing machine having a steam generation unit for injecting high-temperature steam, will be described with reference to FIGS. 1 and 2.

The washing machine according to the first preferred embodiment of the present invention includes a machine case 110, a tub 120, a drum 130, a steam generation unit, a washing heater 160, and a temperature sensor 150. In this embodiment, the washing machine is a drum type washing machine.

The machine case 110 constitutes the external appearance of the drum type washing machine. At the front part of the machine case 110 is formed a laundry inlet hole 111. The tub 120 is mounted in the machine case 110 in a supported state.

The drum 130 is rotatably mounted in the tub 120, and is disposed such that the open side of the drum 130 is directed to the laundry inlet hole 111 of the machine case 110.

A door 140 is mounted to the machine case 110 adjacent to the laundry inlet hole 111 for opening and closing the laundry inlet hole 111. At the inner circumference of the laundry inlet hole 111 is mounted a rim part 112, which accomplishes sealing between the door 140 and the laundry inlet hole 111.

Also, as shown in FIG. 2, at the circumference of the drum 130 are formed a plurality of through-holes 131, through which washing water and steam supplied into the tub 120 are introduced into the drum 130.

The steam generation unit is constructed to supply high-temperature steam into the drum 130. In this embodiment, at least one steam supply unit is provided.

The steam generation unit serves to evaporate water using high-temperature hot air and to supply steam into the drum 130. The steam generation unit includes a steam heater 210 for generating high-temperature hot air to evaporate water, and a steam supply pipe 220, through which steam generated from the water evaporation by the s team heater 210 flows.

Also, the steam generation unit further includes an injection nozzle 230 for injecting the steam flowing through the steam supply pipe 220 into the drum 130.

The injection nozzle 230 is constructed in the shape of a nozzle such that the steam can be smoothly ejected through the nozzle. Preferably, the end of the injection nozzle 230, through which the steam is discharged, extends through the rim part 112 such that the end of the injection nozzle 230 directly communicates with the interior of the drum 130.

The washing heater 160 is mounted in the lower part of the tub 120 for heating the washing water stored in the tub 120.

The temperature sensor 150 is mounted at a predetermined position in the tub 120 for detecting the interior temperature of the tub 120.

In this case, it is preferable that the temperature sensor 150 be adjacent to the washing heater 160 in the lower part of the tub 120.

Hereinafter, an operation control method performed when the steam generation unit is abnormal during a steam washing operation according to the first preferred embodiment of the present invention will be described in detail based on the above-described structure of the drum type washing machine.

As shown in FIG. 3, first, a user puts laundry to be washed into the drum 130, and inputs a desired washing course. At this time, it is determined whether the washing course inputted by the user is a washing operation including steam washing operation (S410).

When the user inputs an operation command for the steam washing operation, the operation conditions for the steam washing operation are set. Specifically, the washing water level and the washing time are set to a first predetermined water level L1 and a first predetermined time T1 (S420).

Subsequently, water is supplied into the drum 130 until the washing water level in the drum 130 reaches the first predetermined water level L1. At this time, water is also supplied into the steam generation unit.

After the water is supplied into the drum up to the first predetermined water level L1, the steam heater 210 is driven to heat the washing water in the steam generation unit such that high-temperature steam is generated. The generated high-temperature steam is injected into the drum 130, and then the steam washing operation is carried out (S430).

At this time, the washing progress time T is counted from the point of time at which the driving of the steam heater 210 is initiated.

While the steam washing operation using the steam injected from the steam generation unit is carried out, it is periodically determined whether a system error related to the steam generation unit (for example, overheating of the steam heater) has occurred (S440).

When it is determined that the error of the steam generation unit is not detected during the steam washing operation as a result of the determination (S440), the steam washing operation is continuously carried out until the counted washing progress time T reaches the first predetermined time T1 set at Step S420 (S450).

When it is determined that the error of the steam generation unit is detected during the steam washing operation as a result of the determination (S440), on the other hand, it is determined whether the washing progress time T at the point of time at which the error was detected has already exceeded a predetermined time T0 (S460).

When it is determined that the washing progress time T at the point of time at which the error was detected has already exceeded the predetermined time T0 as a result of the determination (S460), the driving of the steam generation unit, i.e., the steam heater 210, is interrupted, and the washing heater 160 is driven to heat the washing water floating in the tub 120 (S470).

Specifically, when the error of the steam generation unit has occurred, the steam heater 210 is turned off, and the washing heater 160 is driven, instead of the steam heater 210, such that the current washing operation is continuously carried out.

The washing operation using the driving of the washing heater 160 is continuously carried out until the washing progress time T reaches the first predetermined time T1 (S480).

When it is determined that the washing progress time T at the point of time at which the error was detected has not yet exceeded the predetermined time T0 as a result of the determination (S460), on the other hand, the driving of the steam generation unit is interrupted, and the currently counted washing progress time T is initialized. Then, the operation conditions set at Step S420 are ignored, and the washing water level and the washing time are newly set to a second predetermined water level L2 and a second predetermined time T2 (S490).

Subsequently, the water resupply to the drum is carried out until the washing water level in the drum 130 reaches the second predetermined water level L2. After that, the washing heater 160 is driven, and, at the same time, the washing progress time T is counted (S500).

The washing operation using the driving of the washing heater 160 is carried out during the second predetermined time T2 reset at Step S490 (S510).

When the error of the steam generation unit is detected at Step S440, the washing operation is carried out while an error warning message is outputted to a display unit of the washing machine such that the user can recognize the error of the steam generation unit.

Consequently, the present invention is characterized in that the washing operation is continuously carried out using the washing heater 160, instead of the steam heater 210, when the system error related to the steam generation unit has occurred while the steam washing operation is carried out.

When the error has occurred during the steam washing operation, on the other hand, a decision is made as to whether the operation conditions are to be reset depending upon the elapsed time of the washing operation.

Hereinafter, a tub assembly washing operation method of the washing machine according to the first preferred embodiment of the present invention will be described with reference to FIG. 4.

The tub assembly washing operation method according to the present invention uses a steam washing mode in which high-temperature steam is used to wash the inner/outer wall of the drum 130.

First, when a tub assembly washing course is selected by a user, a control unit (not shown), which controls the operation of the washing machine, controls the steam generation unit to be operated such that steam is supplied into the drum 130 (S110).

At this time, the steam is generated by heat emitted from the steam heater 210. The generated steam sequentially passes through the steam supply pipe 220 and the injection nozzle 230, and is then supplied into the drum 130.

Especially, the steam is continuously supplied into the drum until the interior temperature of the drum 130 reaches a predetermined temperature level. The temperature is detected by the temperature sensor 150 mounted in the tub 120.

Here, the predetermined temperature level is approximately 60° C. and 80° C.

The above-specified temperature range is a temperature range within which contaminants can be removed the most smoothly from the inner wall of the tub 120 or the inner and outer walls of the drum 130, and, at the same time, is a temperature range within which the sterilization of the tub 120 or the drum 130 is possible.

Especially, according to the preferred embodiment of the present invention, the predetermined temperature level is 65° C., which is a temperature level at which the removal and sterilization of the contaminants are possible with the minimum power consumption.

Also, it is preferable that the drum 130 be continuously rotated while the steam supply is carried out, whereby the steam is uniformly supplied into the drum 130 throughout, and therefore, the uniform washing is accomplished.

When the interior temperature of the drum 130 has reached the predetermined temperature level through the above-described process, the operation of the steam generation unit is interrupted (S120), and the tub assembly washing operation is continuously carried out while only the drum 130 is rotated.

At this time, the tub assembly washing operation performed during only the rotation of the drum 130 is carried out for a predetermined period of time.

The above-mentioned predetermined period of time is a time sufficient for the contaminants attached to the inner wall of the tub 120 or the inner and outer walls of the drum 130 to be removed from the inner wall of the tub 120 or the inner and outer walls of the drum 130.

After a predetermined period of time elapses through the above-described process, washing water necessary to carry out a rinsing operation is supplied into the tub 120 (S130), and then the rinsing operation is carried out (S140).

Of course, it is more preferable that a spin-drying operation be carried out before the rinsing operation is carried out, whereby the contaminants left on the inner and outer walls of the drum 130 are primarily discharged out of the drum 130.

Especially, it is preferable that the drum 130 be rotated while the washing water is supplied into the drum 130 to perform the rinsing operation, whereby the contaminants left on the inner and outer walls of the drum 130 are smoothly rinsed out.

Also, the water level of the washing water supplied during the rinsing operation is a water level sufficient to remove the contaminants left on the inner and outer walls of the drum 130.

At this time, it is preferable that the water level of the washing water supplied during the rinsing operation be maintained at a water level at which at least more than ⅕ and less than ⅓ of the total height of the drum 130 (preferably, approximately ¼ of the total height of the drum 130) from the lowermost surface of the drum 130, as shown in FIG. 5.

This is because the water level having the above-specified range is the maximum water level at which the contaminants left inside the drum 130 can be smoothly removed while an excessive amount of washing water is not consumed.

After the above-described rinsing operation is completed, a final water draining operation is carried out (S150), and, at the same time, a final spin-drying operation is carried out (S160). In this way, the operation of the tub assembly washing course is completely performed.

At this time, the contaminants attached to the inner wall of the tub 120 have been removed from the inner wall of the tub 120 by the high-temperature steam during the tub assembly washing operation. Consequently, the removal of the contaminants attached to the inner wall of the tub 120 is more smoothly accomplished by the high-speed rotation of the drum 130 while the final spin-drying operation is carried out.

On the other hand, an operation control method performed when the steam generation unit is abnormal during the above-described tub assembly washing operation will be described in detail with reference to FIG. 6.

As shown in the drawing, the control unit continuously checks for the abnormal state of the steam generation unit while a continuous steam supplying process is carried out until the interior temperature of the drum 130 reaches the predetermined temperature level in the tub assembly washing course (S210).

At this time, the abnormal state of the steam generation unit includes at least one of water level detection error, temperature detection error, impossibility of the heat generation, impossibility of the steam discharge, and impossibility of the water supply in the steam generation unit, or impossibility of the operation of the steam generation unit.

For example, the abnormal state of the steam generation unit may indicate the case that the water level in the steam generation unit does not change although the supply of water to the steam generation unit is carried out or the case that the temperature in the steam generation unit does not change although heat is emitted from the steam heater 210.

When the abnormal state of the steam generation unit is detected through the above-described process, the control unit interrupts the overall operation of the steam generation unit (S220).

Specifically, electric current supplied to the steam heater 210 is interrupted, and, at the same time, the supply of washing water to the steam generation unit is interrupted.

At the same time, the control unit controls the tub assembly washing operation to be carried out according to an algorithm preliminarily set for the tub assembly washing course without using the steam generation unit.

Specifically, the control unit performs a control operation such that the washing water can be supplied into the tub 120, and at the same time, the supplied washing water can be heated, whereby the tub assembly washing operation can be carried out.

More specifically, when the above-specified abnormal state of the steam generation unit is detected, the washing water is supplied into the tub 120 up to a predetermined water level while the operation of the steam generation unit is interrupted (S230).

At this time, the water level of the washing water supplied through the above-described process is a water level at which the lowermost surface of the drum 130 is approximately submerged in the washing water, as shown in FIG. 7.

Especially, it is preferable that the washing water supplied as described above contain detergent necessary for washing the tub assembly.

After the water is supplied up to the predetermined water level through the above-described process, the control unit controls the washing heater 160, which is mounted in the lower-part of the stub 120, to emit heat such that the washing water supplied into the tub 120 can be heated (S240).

At this time, the washing water is approximately heated up to a sterilization temperature. Here, the sterilization temperature is a temperature of 60° C. to 80° C., in which the sterilization of various contaminants is possible. According to the preferred embodiment of the present invention, the sterilization temperature is approximately 75° C.

The temperature of the washing water is detected by the temperature sensor 150.

When the temperature of the washing water reaches sterilization temperature, the heat generation of the washing heater 160 is interrupted (S250). As a result, the heating of the washing water is interrupted. At the same time, the tub assembly washing operation is carried out using the heated washing water (S260).

The tub assembly washing operation is carried out while the drum 130 is continuously rotated.

At this time, the tub assembly washing operation carried out during only the rotation of the drum 130 is carried out for a predetermined period of time.

The above-mentioned predetermined period of time is a time sufficient for the contaminants attached to the inner wall of the tub 120 or the inner and outer walls of the drum 130 to be removed from the inner wall of the tub 120 or the inner and outer walls of the drum 130.

After the predetermined period of time elapses through the above-described process, the washing water is drained out of the tub 120 (S270), and then the same operation as the rinsing operation of the tub assembly washing course using the steam is carried out. In this way, the operation of the tub assembly washing course is completely performed.

As described above, even when the abnormal state of the steam generation unit, for example, the breakdown of the steam generation unit, occurs, the operation of the tub assembly washing course is carried out. Consequently, it is possible to prevent the dissatisfaction of the user caused when the operation of the tub assembly washing course cannot be carried out.

Hereinafter, a method of detecting the abnormal state of the steam generation unit in the above-described process will be described in detail with reference to FIG. 8.

In order to supply steam into the drum 130 during the steam washing operation, the steam heater 210 is driven to generate high-temperature steam, and the generated steam is injected into the drum 130 (S310).

At this time, the washing progress time T is counted from the point of time at which the driving of the steam heater 210 is initiated, and, immediately after the steam heater 210 is driven, the initial temperature of the washing water in the drum 130 is detected by the temperature sensor 150.

The temperature of the washing water is increased by the high-temperature steam injected from the steam generation unit, and the temperature of the washing water is periodically read by the temperature sensor 150 (S320).

When the washing progress time T has exceeded a predetermined time after the steam generation unit is driven (S330), it is determined whether the temperature of the washing water read at the point of time at which the predetermined time has elapsed has increased by more than a predetermined temperature level (for example, more than 1° C.) as compared to the initial temperature of the washing water (S340).

When it is determined that the temperature of the washing water at the point of time at which the predetermined time has elapsed has increased by more than the predetermined temperature level as a result of the determination (S340), it is recognized that the steam generation unit is normally operated, and the steam heater 210 is continuously driven. Subsequently, the procedure is advanced to a step corresponding to Step S450 of the FIG. 3, and then, subsequent operations are carried out in the same manner.

When it is determined that the temperature of the washing water at the point of time at which the predetermined time has elapsed has not increased by more than the predetermined temperature level (for example, more than 1° C.) as a result of the determination (S340), on the other hand, it is recognized that the steam generation unit is abnormal. And the procedure is advanced to a step corresponding to Step S460 of the FIG. 3, and then, subsequent operations are carried out in the same manner.

Consequently, according to the present invention, it is determined that the steam generation unit is abnormal when the change in temperature of the washing water is not detected during the steam washing operation. Furthermore, as can be seen from the operation process as shown in FIG. 3, when the error of the steam generation unit has occurred, the driving of the steam generation unit is interrupted, and the steam washing operation is continuously carried out using the washing heater 160.

Meanwhile, the above-described process controlled when the steam generation unit is abnormal during the steam washing operation according to the first preferred embodiment of the present invention is not applied only to the washing machine having the steam generation unit.

In other words, the above-described process controlled when the steam generation unit is abnormal during the steam washing operation according to the first preferred embodiment of the present invention is also applied to a washing machine having drying function, i.e., a washing-and-drying machine.

Especially, in consideration of the fact that high-temperature dry hot air can be supplied into the drum 130 in the case of the washing-and-drying machine, a control operation may be performed such that, when the steam generation unit is abnormal during the washing operation, the high-temperature dry hot air can be supplied into the drum 130 instead of the steam generation unit.

Consequently, in the case of the washing-and-drying machine, the high-temperature dry hot air is used instead of the high-temperature steam when the steam generation unit is abnormal, and therefore, the current washing operation can be continuously carried out without performing the process of heating the washing water using the washing heater 160.

Hereinafter, a washing machine according to a second preferred embodiment of the present invention, i.e., a washing-and-drying machine having a drying unit for supplying high-temperature dry hot air, will be described in detail.

FIG. 9 is a sectional view schematically illustrating the interior structure of the washing-and-drying machine. The drum type washing machine includes a tub 320 and a drum 330, and the drum type washing machine is further equipped with a drying unit including a drying duct 370, a drying heater 380, and a blowing fan 390.

Unexplained reference numeral 410 indicates a steam heater constituting the steam generation unit, 420 indicates a steam supply pipe constituting the steam generation unit, and 430 indicates an injection nozzle constituting the steam generation unit.

In addition, unexplained reference numeral 350 indicates a temperature sensor, and 360 indicates a washing heater.

Hereinafter, an operation control method performed when the steam generation unit is abnormal during a tub assembly washing operation according to a second preferred embodiment of the present invention will be described in detail based on the above-described structure of the washing-and-drying machine.

As shown in FIG. 10, the control unit continuously checks for the abnormal state of the steam generation unit while an operation processes for a tub assembly washing course is carried out (S610). When the abnormal state of the steam generation unit is detected, the control unit controls the overall operation of the steam generation unit to be interrupted (S620).

This process is the same as the operation method according to the first preferred embodiment of the present invention as described above (FIG. 6).

In the state that the overall operation of the steam generation unit is interrupted, the control unit controls high-temperature dry hot air to be supplied into the tub 320 (S630).

At this time, the dry hot air is continuously supplied until the interior temperature of the drum 330 reaches a sterilization temperature. Here, the sterilization temperature is a temperature of 60° C. to 80° C., in which the sterilization of various contaminants is possible. According to the preferred embodiment of the present invention, the sterilization temperature is approximately 75° C.

Also, it is preferable that the drum 330 be rotated while the high-temperature dry hot air is supplied as descried above, whereby the sterilization is uniformly accomplished throughout the drum 330 using the high-temperature hot air, and the smooth separation of contaminants from the drum 330 is accomplished.

When the interior temperature of the drum 330 has reached the sterilization temperature through the above-described process, the supply of the dry hot air is interrupted (S640), and the tub assembly washing operation is continuously carried out while only the drum 330 is rotated.

At this time, the tub assembly washing operation carried out during only the rotation of the drum 330 is carried out for a predetermined period of time.

The above-mentioned predetermined period of time is a time sufficient for the contaminants attached to the inner wall of the tub 320 or the inner and outer walls of the drum 330 to be removed from the inner wall of the tub 320 or the inner and outer walls of the drum 330.

After the predetermined period of time elapses through the above-described process, washing water necessary for performing a rinsing operation is supplied into the tub 320 (S650), and then the same rinsing operation as subsequent operation of the tub assembly washing course using the steam as described above is carried out (S660). After that, a water draining operation and a spin-drying operation are sequentially carried out (S670). In this way, the operation of the tub assembly washing course is completely performed.

Industrial Applicability

Meanwhile, the technical idea of the present invention is not limited to the above-described preferred embodiments.

That is, the operation control method of the washing machine is a useful invention which can be applied to a general pulsator type washing machine as well as a drum type washing machine.

The invention claimed is:

1. A control method of a laundry machine comprising:

detecting whether a steam generator having a steam heater is operating abnormally while the laundry machine is operating a course in which steam is supplied into a drum; and stopping the steam generator and starting a washing heater mounted in a tub or drying heater to supply dry hot air into the drum instead of operating the steam generator, when the steam generator operating abnormally is detected, wherein the steam generator operating abnormally includes at least one of a water level detection error, a temperature detection error, an insufficient heat generation of the steam heater, an insufficient steam discharge, and an insufficient water supply in the steam generator.

2. The control method according to claim 1, wherein the course is a tub washing course comprising:

generating and supplying high-temperature steam into a drum while rotating the drum;

stopping the steam generator when an inside temperature (T) of the drum exceeding a predetermined temperature level (T1) has been detected; and keeping the drum rotating.

3. The control method according to claim 2, wherein the predetermined temperature level (T1) is within approximately 60° C. ~80° C.

4. The control method according to claim 2, wherein the tub washing course further comprises:

supplying washing water up to a predetermined water level (H) after the steam generation is stopped and a predetermined period of time (t) has elapsed;

rinsing the tub using the supplied washing water while rotating the drum; and draining the washing water and spin-drying the drum after the rinsing is completed.

5. The control method according to claim 4, wherein the predetermined water level (H) is a water level at which the lowermost surface of the drum is submerged in the washing water.

6. The control method according to claim 1, wherein the detecting step comprises:

detecting an inside temperature of the drum and starting a count;

detecting an inside temperature of the drum when the count has exceeded a predetermined time, and comparing the previously detected temperature with the currently detected temperature; and determining that the steam generator is operating abnormally when a difference in compared temperatures has not increased by more than a predetermined temperature level.

7. An control method of a laundry machine, comprising:

detecting whether a steam generator having a steam heater is operating abnormally while the laundry machine is operating a course; and stopping the steam generator and starting a drying heater to supply dry hot air into a drum when the steam generator operating abnormally is detected, wherein the steam generator operating abnormally includes at least one of a water level detection error, a temperature detection error, an insufficient heat generation of the steam heater, an insufficient steam discharge, and an insufficient water supply in the steam generator.

8. The control method according to claim 7 wherein the detecting step comprises:

detecting an inside temperature of the drum and starting a count;

detecting an inside temperature of the drum when the count has exceeded a predetermined time, and comparing the previously detected temperature with the currently detected temperature; and determining that the steam generator is operating abnormally when a difference in compared temperatures has not increased by more than a predetermined temperature level.

9. The control method according to claim 7, wherein the laundry machine further comprises rotating the drum while supplying dry hot air into the drum.

10. The control method according to claim 7, wherein starting the drying heater to supply dry hot air further comprises generating and supplying dry hot air into the drum while rotating the drum;

stopping the drying heater when an inside temperature (T) of the drum exceeding a predetermined temperature level (T1) has been detected; and keeping the drum rotating.

11. A control method of a laundry machine for performing a course comprising a washing operation in which steam is supplied into a drum, a rinsing operation and a spin-drying operation, the method comprising:

detecting whether a steam generator having a steam heater is operating abnormally while performing the washing operation with one or more first operation conditions;

stopping the steam generator, starting a washing heater mounted in a tub or a drying heater to supply dry hot air into a drum instead of operating the steam generator, and continuing the washing operation, when the steam generator operating abnormally is detected, wherein the steam generator operating abnormally includes at least one of a water level detection error, a temperature detection error, an insufficient heat generation of the steam heater, an insufficient steam discharge, and an insufficient water supply in the steam generator.

12. The control method according to claim 11, wherein the one or more first operation conditions includes at least one of a water level inside a tub, a washing operation time, and a washing water heating temperature.

13. The control method according to claim 11, wherein the detecting step comprises:

detecting whether an inside temperature of a drum has changed since steam was supplied into the drum; and determining that the steam generator is operating abnormally when the inside temperature of the drum detected has not changed.

14. The control method according to claim 11, wherein the detecting step comprises:

detecting an inside temperature of the drum and starting a count;

detecting an inside temperature of the drum at a point in time in which the count has exceeded a predetermined time and comparing the previously detected temperature with the currently detected temperature; and determining that the steam generator is operating abnormally when a difference in compared temperatures has not increased by more than a predetermined temperature level.

15. The control method according to claim 11, wherein, in the continuing the washing operation step, the washing operation is continued with one or more second operation conditions when the steam generator operating abnormally is detected before a predetermined time.

16. The control method according to claim 15, wherein, in the continuing washing operation step, the washing operation is continued with the one or more first operation conditions when the steam generator operating abnormally is detected after the predetermined time.

17. An control method of a laundry machine for performing a course comprising a washing operation, a rinsing operation and a spin-drying operation, the method comprising:

detecting whether a steam generator having a steam heater is operating abnormally while performing the washing operation with one or more first operation conditions;

stopping the steam generator, starting a drying heater to supply dry hot air into a drum, and continuing the washing operation when the steam generator operating abnormally is detected, wherein the steam generator operating abnormally includes at least one of a water level detection error, a temperature detection error, an insufficient heat generation of the steam heater, an insufficient steam discharge, and an insufficient water supply in the steam generator.

18. A control method of a laundry machine according to claim 17, wherein the detecting step comprises:

detecting an inside temperature of a drum and starting a count;

detecting an inside temperature of the drum when the count has exceeded a predetermined time; and comparing the previously detected inside temperature with the currently detected inside temperature to detect whether the steam generator is operating abnormally.

* * * * *